US010260814B2

(12) United States Patent
Katsumata et al.

(10) Patent No.: US 10,260,814 B2
(45) Date of Patent: Apr. 16, 2019

(54) CONVEYANCE DEVICE FOR HEAT TREATMENT DEVICE AND HEAT TREATMENT DEVICE

(71) Applicants: IHI Corporation, Tokyo (JP); IHI Machinery and Furnace Co., Ltd., Tokyo (JP)

(72) Inventors: Kazuhiko Katsumata, Inuyama (JP); Kaoru Isomoto, Tokyo (JP); Gen Nishitani, Kakamigahara (JP); Akira Nakayama, Hikari (JP); Takahiro Nagata, Kamo-gun (JP); Yuusuke Shimizu, Gifu (JP)

(73) Assignees: IHI CORPORATION, Tokyo (JP); IHI MACHINERY AND FURNACE CO., LTD., Tokyo (JP)

( * ) Notice: Subject to any disclaimer, the term of this patent is extended or adjusted under 35 U.S.C. 154(b) by 227 days.

(21) Appl. No.: 15/284,747

(22) Filed: Oct. 4, 2016

(65) Prior Publication Data

US 2017/0023304 A1 Jan. 26, 2017

Related U.S. Application Data

(63) Continuation of application No. PCT/JP2015/068986, filed on Jul. 1, 2015.

(30) Foreign Application Priority Data

Jul. 28, 2014 (JP) ..... 2014-152858

(51) Int. Cl.
*F27D 3/04* (2006.01)
*C21D 1/667* (2006.01)
(Continued)

(52) U.S. Cl.
CPC ..... *F27D 3/04* (2013.01); *C21D 1/667* (2013.01); *C21D 1/773* (2013.01); *F27B 9/18* (2013.01);
(Continued)

(58) Field of Classification Search
CPC ..... F27B 9/18; F27D 3/04
See application file for complete search history.

(56) References Cited

U.S. PATENT DOCUMENTS 1,881,828 A * 10/1932 Millar ..... F27D 3/04 104/162
6,523,676 B1 2/2003 Nakatsukasa et al.
(Continued)

FOREIGN PATENT DOCUMENTS

CN 1308217 A 8/2001
CN 101619927 A 1/2010
(Continued)

*Primary Examiner* — Scott R Kastler
(74) *Attorney, Agent, or Firm* — Rothwell, Figg, Ernst & Manbeck, P.C.

(57) ABSTRACT

A conveyance device for a heat treatment device presses a conveyed body to convey the conveyed body in a linear direction, and includes a cylinder mechanisms having a retractable rod that presses the conveyed body, in which: an abutting member is disposed at a tip part of the rod of the cylinder mechanism so that the abutting member abuts locations, which are different from each other in a circumferential direction, on an outer peripheral surface of the conveyed body; a guide rail configured to guide the abutting member is provided; and the abutting member is provided with a traveling roller that travels on the guide rail.

9 Claims, 5 Drawing Sheets

(51) Int. Cl.

| | |
|---|---|
| ***F27B 9/18*** | (2006.01) |
| ***F27D 3/00*** | (2006.01) |
| ***F27B 17/00*** | (2006.01) |
| ***F27D 15/02*** | (2006.01) |
| ***C21D 1/773*** | (2006.01) |
| *C21D 1/00* | (2006.01) |

(52) U.S. Cl.
CPC ..... *F27B 17/0016* (2013.01); *F27D 3/0024* (2013.01); *F27D 15/02* (2013.01); *C21D 1/00* (2013.01)

(56) References Cited

U.S. PATENT DOCUMENTS

| | | | | |
|---|---|---|---|---|
| 9,193,529 | B2 | 11/2015 | Yokota | |
| 2001/0050212 | A1 | 12/2001 | Nakatsukasa et al. | |
| 2012/0000265 | A1 | 1/2012 | Watabe et al. | |
| 2013/0153547 | A1 | 6/2013 | Katsumata | |
| 2014/0231223 | A1 | 8/2014 | Yokota | |
| 2017/0023304 | A1* | 1/2017 | Katsumata ..... | C21D 1/667 |

FOREIGN PATENT DOCUMENTS

| | | | |
|---|---|---|---|
| CN | 202947478 | U | 5/2013 |
| CN | 103891423 | A | 6/2014 |
| JP | 54-143819 | U | 10/1979 |
| JP | 61-137655 | U | 8/1986 |
| JP | 2001-220659 | A | 8/2001 |
| JP | 2003-183081 | A | 7/2003 |
| JP | 2005-9702 | A | 1/2005 |
| JP | 2010-229451 | A | 10/2010 |
| JP | 2012-13341 | A | 1/2012 |
| WO | 2012/063926 | A1 | 5/2012 |

* cited by examiner

CONVEYANCE DEVICE FOR HEAT TREATMENT DEVICE AND HEAT TREATMENT DEVICE

TECHNICAL FIELD

Embodiments described herein relates to a conveyance device for heat treatment device and a heat treatment device.

This application is a continuation application based on a PCT Patent Application No. PCT/JP2015/068986, filed on Jul. 1, 2015, whose priority is claimed on Japanese Patent Application No. 2014-152858, filed on Jul. 28, 2014. The contents of both the PCT Application and the Japanese Application are incorporated herein by reference.

BACKGROUND ART

In the related art, heat treatment devices including a heating chamber and a cooling chamber are used in order to perform treatment such as quenching or the like on a metal part serving as a treatment object. For example, Patent Document 1 discloses a heat treatment device in which a plurality of heating chambers are provided above an intermediate conveyance chamber, and a cooling chamber is provided below the intermediate conveyance chamber. In the heat treatment device disclosed in Patent Document 1, a push device made of a cylinder mechanism is used in order to perform delivery (conveyance) of a treatment object between the intermediate conveyance chamber and the heating chamber. Specifically, the treatment object is conveyed to a front heating chamber by placing the treatment object on a disk-like tray (a conveyed body), and pressing the tray with the push device to push out the tray in a horizontal direction.

Additionally, Patent Documents 2 to 4 also disclose a heat treatment device that conveys a treatment object by pressing the treatment object with the pusher device.

CITATION LIST

Patent Documents

Patent Document 1: Japanese Unexamined Patent Application, First Publication No. 2012-13341

Patent Document 2: Japanese Unexamined Patent Application, First Publication No. 2001-220659

Patent Document 3: PCT International Publication No. WO2012/063926

Patent Document 4: Japanese Unexamined Patent Application, First Publication No. 2005-009702

SUMMARY

However, in the cylinder mechanism that constitutes the push device, a tip of a rod serving as a pressing end presses the disk-like tray in a state where the tip of the rod comes in contact with one location of an outer peripheral surface of the disk-like tray at a point (line). Therefore, the pressing position of the rod with respect to the tray may deviate due to a positional deviation of the tray. Additionally, if the center of gravity of a treatment object placed on the tray deviates from the center of the tray, the tray may be unable to be conveyed forward in an intended linear direction, and the tray may be conveyed while deviating. Thus, the tray may be unable to be conveyed to an intended predetermined position in the heating chamber.

This disclosure has been made in view of the above circumstances, and an object thereof is to provide a conveyance device for a heat treatment device that can accurately convey a conveyed body, on which a treatment object is placed, forward in an intended linear direction, and a heat treatment device including the same.

A first aspect of this disclosure is a conveyance device for a heat treatment device that presses a conveyed body to convey the conveyed body in a linear direction, the conveyance device, and includes a cylinder mechanism which includes a retractable rod that presses the conveyed body, in which: an abutting member is disposed at a tip part of the rod of the cylinder mechanism so that the abutting member abuts locations, which are different from each other in a circumferential direction, on an outer peripheral surface of the conveyed body; a guide rail configured to guide the abutting member is provided; and the abutting member is provided with a traveling roller that travels on the guide rail.

According to the conveyance device for a heat treatment device and the heat treatment device of this disclosure, the abutting member is disposed at the tip part of the rod pressing the conveyed body so that the abutting member abuts different locations in the circumferential direction on the outer peripheral surface of the conveyed body. That is, the abutting member serving as a pressing end presses the conveyed body in a state where the abutting member comes in contact with the different locations in the circumferential direction on the outer peripheral surface of the conveyed body. Therefore, even if the pressing position of the rod with respect to the conveyed body deviates in some degree due to the positional deviation of the conveyed body or the center of gravity of the treatment object that is placed on the conveyed body deviates from the center of the conveyed body, the conveyed body can be accurately conveyed forward in an intended linear direction.

DESCRIPTION OF EMBODIMENTS

Hereinafter, this disclosure will be described below with reference to the drawings. In the following drawings, scales of respective members are appropriately changed in order to make the respective members have recognizable sizes.

Figure 1:
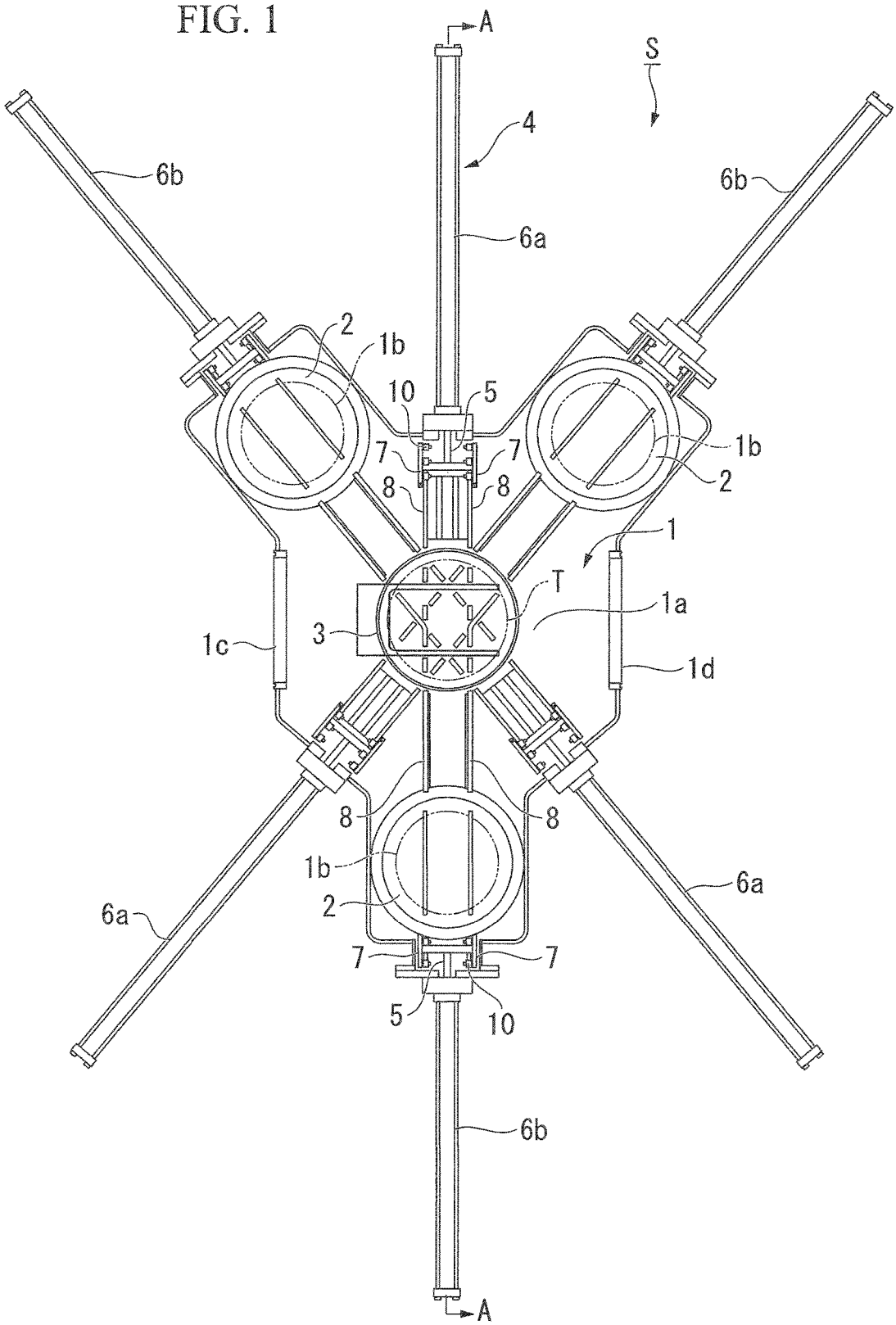
FIG. 1 is a plan view illustrating the outline of an embodiment of a heat treatment device related to this disclosure.
Figure 2:
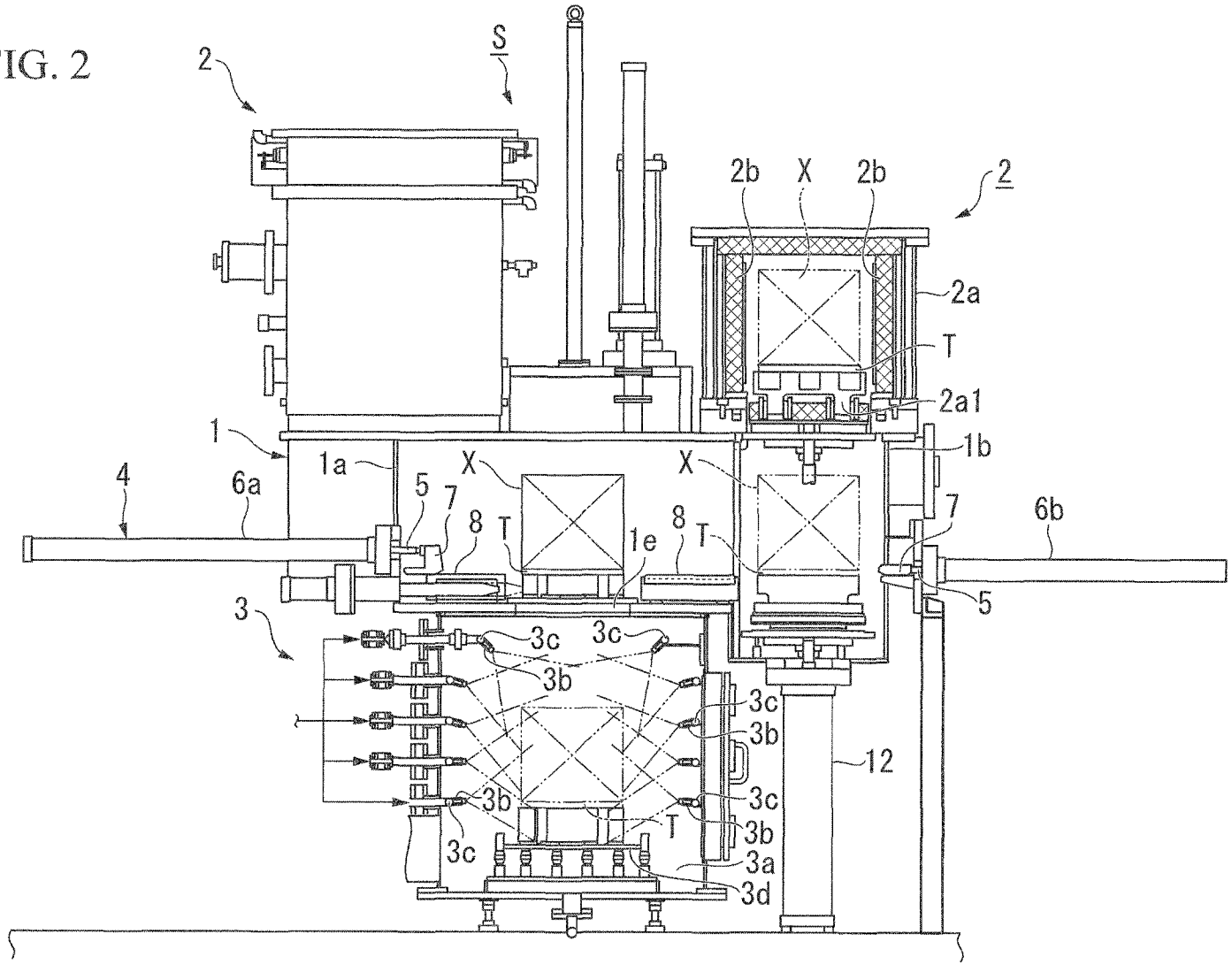
FIG. 2 is a sectional view as seen from arrow A-A of FIG. 1.

FIG. 1 is a plan view illustrating the outline of an embodiment of a heat treatment device related to this disclosure, and FIG. 2 is a sectional view as seen from arrow A-A of FIG I. As illustrated in these drawings, a heat treatment device S of the present embodiment is a heat treatment device for performing quenching processing on a treatment object X that is a metal part, and includes an intermediate conveyance chamber 1 (a conveyance chamber), a heating device 2, a cooling device 3, and a horizontal conveyance device 4 (a conveyance device for a heat treatment device).

The intermediate conveyance chamber 1, as illustrated in FIG. 2, is arranged between the heating device 2 and the cooling device 3, and is a room configured to perform loading and unloading of the treatment object X with respect to the heat treatment device S and to convey the treatment object X between the heating device 2 and the cooling device 3. The treatment object X is carried out to the heat treatment device S in a state where the treatment object X is placed on a disk-like tray T (a conveyed body), and is further conveyed to the heating device 2 or the cooling device 3. The tray T has a predetermined thickness through which a large number of holes passing between upper and lower surfaces of the tray are formed, and when processing such as heating or cooling is performed on the treatment object X placed on the tray T, treatment media, such as treatment gas or a refrigerant, are able to come into direct contact with the treatment object X through the large number of holes.

The intermediate conveyance chamber 1 has a central chamber 1*a* and lifting chambers 1*b* for a heating chamber.

The central chamber 1*a*, as illustrated in FIG. 1, is a room through which all of the treatment objects X, which are treated by the heat treatment device S of the present embodiment, pass, and a side wall thereof is provided with a carrying-in door 1*c* and a carrying-out door 1*d* that serve as an inlet and an outlet to the heat treatment device S. The treatment object X is carried into the central chamber 1*a* through the carrying-in door 1*c* in a state where the treatment object X is placed on the tray T as mentioned above, and after treatment, the treatment objects X is carried out of the central chamber 1*a* through the carrying-out door 1*d* in a state where the treatment object X is placed on the tray T.

The lifting chambers 1*b* for a heating chamber and the horizontal conveyance device 4 are provided to the side wall of the central chamber 1*a*, as illustrated in FIG. 2. The horizontal conveyance device 4 is one embodiment of the conveyance device in this disclosure. The horizontal conveyance device 4 presses the tray T, on which the treatment object X is placed, to transfer the tray T in the linear direction, and conveys the tray T from the central chamber 1*a* to the lifting chamber 1*b* for a heating chamber. Additionally, the horizontal conveyance device 4 conveys the tray T, on which the treatment object X after heat treatment is placed, from the lifting chamber 1*b* for a heating chamber to the central chamber 1*a*.

Figure 3:
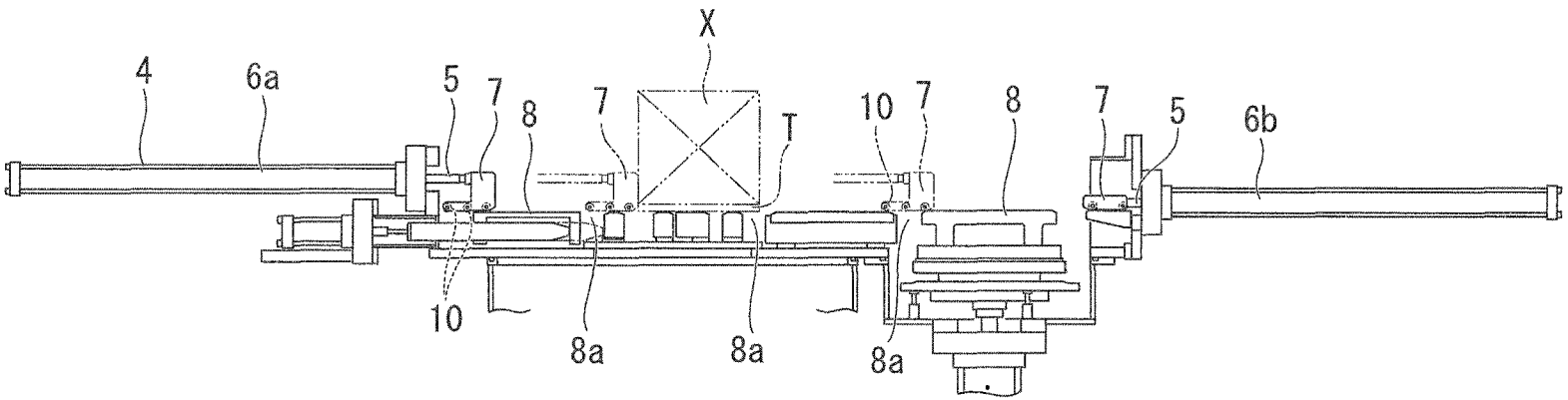
FIG. 3 is a front view illustrating the outline of a horizontal conveyance device.

The horizontal conveyance device 4, as illustrated in FIGS. 2 and 3, has two types of cylinder mechanisms 6*a* and cylinder mechanisms 6*b* each having a retractable pusher 5 (a rod) that presses the tray T, pairs of abutting members 7 disposed at tip parts of the pushers 5, respectively, and guide rails 8 that guide the pairs of abutting members 7, respectively. The cylinder mechanism 6*a* and the cylinder mechanism 6*b* have a well-known configuration in which the pushers 5 are retractably held within pusher cylinders (not illustrated).

One cylinder mechanism 6*a* linearly conveys the tray T toward the lifting chamber 1*b* for a heating chamber from the central chamber 1*a*, and the other cylinder mechanism 6*b* linearly conveys the tray T toward the central chamber 1*a* from the lifting chamber 1*b* for a heating chamber. That is, the cylinder mechanism 6*a* and the cylinder mechanism 6*b* are arranged to confront each other. The pusher 5 of the cylinder mechanism 6*a* is advanced and retracted from a predetermined position within the central chamber 1*a* to a predetermined position within the lifting chamber 1*b* for a heating chamber. The pusher 5 of the cylinder mechanism 6*b* is advanced and retracted from a predetermined position within the lifting chamber 1*b* for a heating chamber to a predetermined position within the central chamber 1*a*. Since the present embodiment has three lifting chambers 1*b* for a heating chamber as illustrated in FIG. 1, the horizontal conveyance device 4 has three sets of groups each having the cylinder mechanism 6*a* and the cylinder mechanism 6*b*.

Figure 4A:
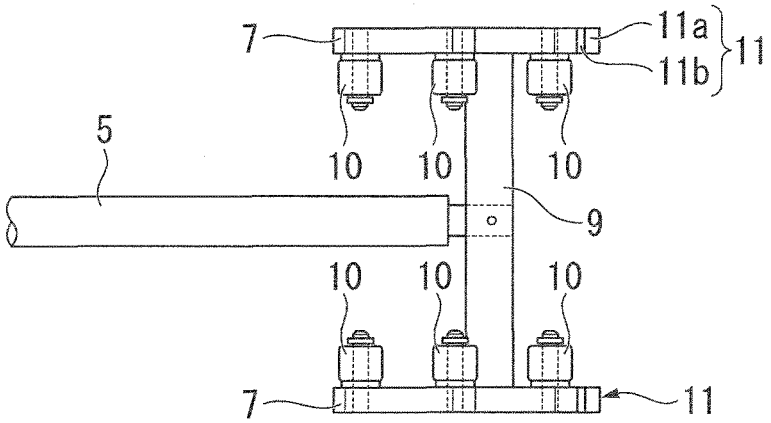
FIG. 4A is a plan view illustrating the outline of abutting members of one cylinder mechanism.
Figure 4B:
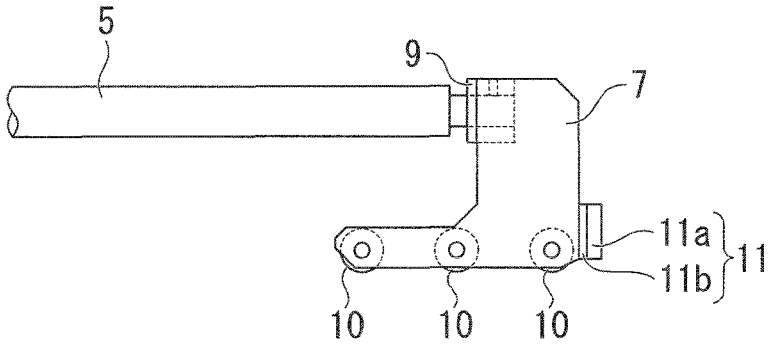
FIG. 4B is a front view illustrating the outline of the abutting members of the one cylinder mechanism.

The pair of abutting members 7 arranged at the tip part of the pusher 5 of the cylinder mechanism 6*a*, as illustrated in FIG. 4A and 4B, are attached and fixed to both end parts of a connecting bar 9, which is connected to the tip part of the pusher 5, by welding, screwing, or the like. Each abutting member 7, as illustrated in FIG. 4B, is a plate member formed substantially in an L-shape, and has a plurality of traveling rollers 10 disposed along a traveling direction on an inner side of a lower end part of the abutting member 7. The traveling rollers 10 travel on the guide rail 8 and are thereby guided by the guide rail 8. That is, the abutting member 7 having the traveling rollers 10 is guided by the guide rail 8 and is advanced and retracted.

In the present embodiment, a lower end side of the tip part of the abutting member 7 serves as an abutment location where the abutting member 7 abuts the tray T. In the present embodiment, adjusting mechanisms 11 that adjust the length of the abutting members 7 are provided at the tip parts of the abutting members 7 so that, for example in a case where the positions of abutting surfaces of the abutment locations of the pair of abutting members 7 deviate from each other forward and backward, the positions of the abutting surfaces are aligned with each other.

The adjusting mechanism 11 has a plate-like stone member 11*a* detachably attached to the lower end side of the tip part of each abutting member 7 by screwing, and a thin plate 11*b* (shim) interposed between the abutting member 7 and the stone member 11*a* if necessary for adjustment of length. With this configuration, the stone member 11*a* attached to the lower end side of the tip part of the abutting member 7 serves as the abutment location that abuts the tray T. Since the tray T immediately after the tray T comes out of the heating device 2 has a high temperature, the stone member 11*a* made of ore with a lower coefficient of thermal expansion than metal is used for the abutment location so that a part directly abutting the tray T is not influenced by temperature.

The stone member 11*a* has variation in its thickness, and as the use of the stone member proceeds, the stone member 11*a* is worn out and the thickness of the stone member 11*a* changes. Therefore, a positional deviation in a forward-backward direction may occur between the abutting surfaces of the abutment locations of the pair of abutting members 7. Therefore, in a case where such a positional deviation has occurred, by interposing the thin plate(s) 11*b* in one or both of the abutting members 7, the positional deviation can be eliminated. That is, the adjusting mechanism 11 of the present embodiment can eliminate the positional deviation between the abutting surfaces of the abutment locations of the pair of abutting members 7 by interposing the thin plate 11*b* to adjust the length of the abutting member 7.

Figure 5A:
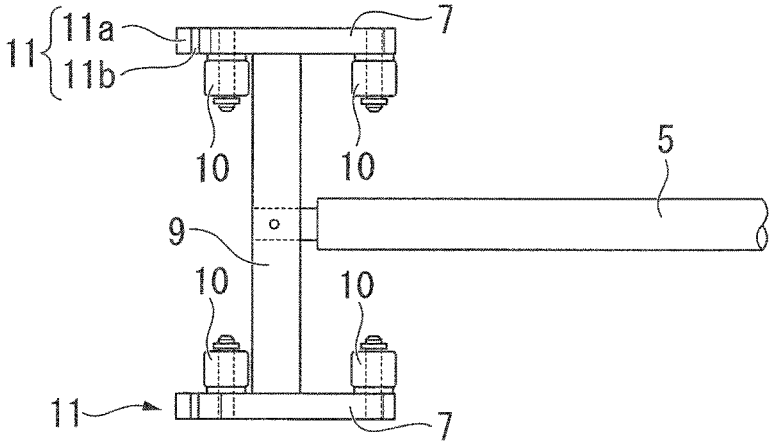
FIG. 5A is a plan view illustrating the outline of abutting members of the other cylinder mechanism.
Figure 5B:
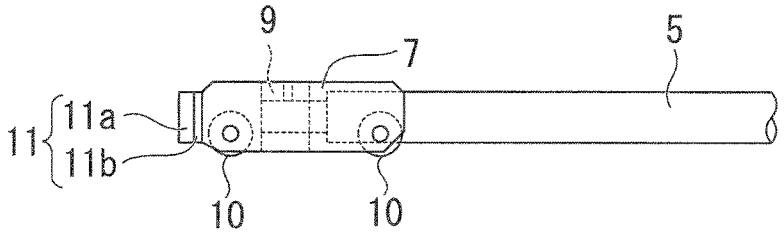
FIG. 5B is a front view illustrating the outline of the abutting member of the other cylinder mechanism.

The pair of abutting members 7 arranged at the tip part of the pusher 5 of the other cylinder mechanism 6*b*, as illustrated in FIGS. 5A and 5B, are also attached and fixed to both end parts of a connecting bar 9 which is connected to the tip part of the pusher 5 by welding, screwing, or the like. However, the abutting member 7 on the cylinder mechanism 6*b* side, as illustrated in FIG. 5B, is a plate member formed substantially in a rectangular plate shape, and has a plurality of traveling rollers 10 disposed along the traveling direction on an inner side of a lower end part of the abutting member 7. The traveling rollers 10 also travel on the guide rail 8 and are thereby guided by the guide rail 8.

A lower end side of the tip part of the abutting member 7 on the cylinder mechanism 6*b* side also serves as an abutment location where the abutting member 7 abuts the tray T. Each of the abutting members 7 is also provided with the adjusting mechanism 11 for eliminating the positional deviation between the abutting surfaces of the abutment locations of the pair of abutting members 7 by interposing the thin plate 11*b* between the abutting member 7 and the stone member 11*a* to adjust the length of the abutting member 7.

Here, the pair of abutting members 7, as illustrated in FIG. 4A, are attached to the both end parts of the connecting bar 9 arranged in a horizontal direction so that the pair of abutting members 7 are arranged with a predetermined gap, which is equivalent to the length of the connecting bar 9 in the horizontal direction, formed therebetween. Accordingly, as can be understood from FIG. 1, the pair of abutting members 7 abut two locations, which are different from each other in the circumferential direction, on the outer peripheral surface of the tray T.

A distance between the pair of abutting members 7 determined depending on the length of the connecting bar 9 is set so that the stone members 11*a* of the abutting members 7 abut two locations, which are sufficiently spaced apart from each other in the circumferential direction, on the outer peripheral surface of the tray T. For example, the distance between the abutting members 7 is set to be about 0.5 times to 1.3 times greater than the radius of the tray T. By setting the distance between the abutting members 7 to such a range, when the tray T is pressed by the cylinder mechanism 6*a* (or the cylinder mechanism 6*b*) as will be described below, the tray T can be conveyed accurately, that is, straightly, toward an intended front, even if the pressing position of the pusher 5 with respect to the tray T deviates in some degree from the center of the tray T due to the positional deviation of the tray T or the center of gravity of the treatment object X that is placed on the tray T deviating from the center of the tray T.

For example, there may occur a case where an initial position of the tray T when the tray T is carried into the central chamber 1*a* deviates from a setting position of the tray T, and therefore at the beginning when the abutting members 7 abut the tray T, only one abutting member 7 abuts the tray T due to the positional deviation of the tray T. However, then, the pusher 5 is advanced and the position of the tray T is corrected by pressing the tray T using the one abutting member 7. Moreover, by also pressing the tray T by the other abutting member 7 immediately after that, the tray T is returned to a regular position and is stably and accurately conveyed by the pair of abutting members 7. That is, the tray is straightly conveyed in the linear direction.

The guide rails 8 are arranged along movement directions (advance and retraction directions) of the respective abutting members 7 in correspondence with the cylinder mechanism 6*a* and the cylinder mechanism 6*b*, respectively, as illustrated in FIGS. 1 to 3. As illustrated in FIG. 1, at a central part of the central chamber 1*a*, the movement directions of the abutting members 7 of the cylinder mechanism 6*a* and the cylinder mechanism 6*b* overlap each other. Therefore, the guide rails 8 are intermittently arranged via a plurality of gaps 8*a* (refer to FIG. 3) in length directions thereof so as not to interfere with each other.

When the gaps 8*a* are formed in each guide rail 8 in this way, the traveling rollers 10 may fall and fit into the gaps 8*a* when the traveling rollers 10 of the abutting members 7 illustrated in FIGS. 4A and 4B and FIGS. 5A and 5B travel on the guide rails 8. Thus, in the present embodiment, three traveling rollers 10 are provided along the movement direction (traveling direction) of each abutting member 7 on the cylinder mechanism 6*a* side as illustrated in FIGS. 4A and 4B, and two traveling rollers 10 are provided along the movement direction (traveling direction) of each abutting member 7 on the cylinder mechanism 6*b* side as illustrated in FIGS. 5A and 5B.

The traveling rollers 10 are arranged so that a distance between two traveling rollers 10 located at outermost portions among the plurality of traveling rollers 10 becomes longer than the length of the gap 8*a* having the greatest length among the gaps 8*a* of the guide rail 8 on which the traveling rollers 10 travel directly. With this configuration, since at least one traveling roller 10 among the plurality of traveling rollers 10 coupled to the abutting member 7 is located on the guide rail 8 when the abutting member 7 passes above the gap 8*a* as illustrated by two-dot chain lines in FIG. 3, not all the traveling rollers 10 fall and fit into the gap 8*a*. Therefore, the abutting member 7 stably travels on the guide rail 8 by virtue of the traveling rollers 10.

Additionally, since the traveling rollers 10 are provided on the abutting member 7 in this way, and the traveling rollers 10 travel on the guide rail 8 when the pusher 5 is advanced and retracted, the distal end side (the abutting member 7 side) of the pusher 5, which is held in a cantilevered fashion by the pusher cylinder, can be prevented from hanging down due to the pusher's own weight. That is, hanging-down of the abutting member 7 can be prevented by supporting the abutting member 7 with the traveling rollers 10 and the guide rail 8.

As illustrated in FIG. 2, each lifting chamber 1*b* for a heating chamber is a room where the treatment object X which is to be carried into the heating chamber 2*a* from the intermediate conveyance chamber 1 or the treatment object X which has been carried out to the intermediate conveyance chamber 1 from the heating chamber 2*a* is contained. The lifting chamber 1*b* for a heating chamber is formed to be capable of containing a floor part 2*a*1 that enables the heating chamber 2*a* to be opened and closed, and contains the treatment object X placed on the tray T together with the floor part 2*a*1. The floor part 2*a*1 is raised and lowered by a lifting mechanism 12 for a heating chamber provided in each lifting chamber 1*b* for a heating chamber. The other cylinder mechanism 6*b* of the horizontal conveyance device 4 is attached to the side wall of each lifting chamber 1*b* for a heating chamber.

In the intermediate conveyance chamber 1, the heating device 2 is provided above the lifting chamber 1*b* for a heating chamber, and the cooling device 3 is provided below the central chamber 1*a*. That is, in the present embodiment, the heating device 2 is provided above the intermediate conveyance chamber 1, and the cooling device 3 is provided below the intermediate conveyance chamber 1.

A gas supply device (not illustrated) for supplying atmosphere-forming gas to the inside of the intermediate conveyance chamber 1 is connected to the intermediate conveyance chamber 1. Accordingly, for example, nitrogen gas is supplied to the intermediate conveyance chamber 1 as the atmosphere-forming gas. In addition to the intermediate conveyance chamber 1, the atmosphere-forming gas is similarly supplied to a cooling chamber 3*a* (to be described below) of the cooling device 3. Additionally, a vacuum pump (not illustrated) for vacuuming the inside of the intermediate conveyance chamber 1 is also connected to the intermediate conveyance chamber 1.

The heating device 2 includes heating chambers 2*a* and heaters 2*b*. Each heating chamber 2*a* is a cylindrical room where heat treatment of the treatment object X is performed, and is installed above each lifting chamber 1*b* for a heating chamber.

The heaters 2*b* are provided inside the heating chambers 2*a*, and the treatment object X contained in the heating chamber 2*a* is heat-treated by heat generated from the heaters 2*b*. The heater 2*b* may be an electro-thermal heater using nickel chrome (Ni—Cr), molybdenum (Mo), or graphite as a heating element, a heater that performs heating with high-frequency power, or the like.

A gas supply device (not illustrated) for supplying atmosphere-forming gas to the inside of the heating chamber 2*a* is connected to the heating chamber 2*a*. For example, nitrogen gas and acetylene gas are supplied to the inside of the heating chamber 2*a* as the atmosphere-forming gas. Additionally, a vacuum pump for a heating chamber (not illustrated) for vacuuming the inside of the heating chamber 2*a* is connected to each heating chamber 2*a*.

The cooling device 3 is attached to a lower side of the central chamber 1*a*. A central part of a floor part of the central chamber 1*a* is provided with an opening that allows the central chamber 1*a* (that is, the intermediate conveyance chamber 1) to communicate with the cooling chamber 3*a* of the cooling device 3. This opening is made closable by an openable and closable upper lid 1*e*. The guide rail 8 is formed on an upper surface of the upper lid 1*e* so that the tray T (the treatment object X) is made movable via the upper lid 1*e*. The upper lid 1*e* is raised and lowered by an upper lid lifting mechanism (not illustrated).

The cooling device 3 includes the cooling chamber 3*a*, nozzles 3*b*, header tubes 3*c*, and a lift table 3*d*. The cooling chamber 3*a* is a heat treatment chamber where the treatment object X is cooled with the latent heat of mist that is liquid particles, and is connected to the lower side of the central chamber 1*a* of the intermediate conveyance chamber 1. That is, in the present embodiment, the intermediate conveyance chamber 1 where conveyance of the treatment object X is performed is provided above the cooling chamber 3*a*. A plurality of nozzles 3*b* are installed inside the cooling chamber 3*a*, and spray mist into the cooling chamber 3*a*. The header tube 3*c* is connected to each nozzle 3*b*, and supplies coolant to each nozzle 3*b*.

The treatment object X and the tray T are placed on the lift table 3*d* in the cooling chamber 3*a*. The lift table 3*d* can be raised and lowered by a lifting mechanism for a cooling chamber (not illustrated), and closes the opening provided at the central part of the floor part of the central chamber 1*a* when the lift table 3*d* is lifted most. The guide rail 8 is provided on the upper surface of the lift table 3*d* so that the guide rail 8 is located inside the central chamber 1*a* when the lift table 3*d* closes the opening provided at the central part of the floor part of the central chamber 1*a*.

The cooling device 3 also includes a coolant recovery supply device (not illustrated) that recovers a coolant from the cooling chamber 3*a*, cools the recovered coolant again, and supplies the cooled coolant to the header tubes 3*c*, and a vacuum pump that vacuums the inside of the cooling chamber 3*a*, and the like.

Heat treatment of the treatment object X in the heat treatment device S having such a configuration is performed under the control of a control device (not illustrated).

First, the treatment object X is carried into the central chamber 1*a* of the intermediate conveyance chamber 1 in a state where the treatment object X is placed on the tray T. Subsequently, the tray T on which the treatment object X is placed is pressed by the cylinder mechanism 6*a* in the horizontal conveyance device 4, and the tray T is horizontally conveyed to the lifting chamber 1*b* for a heating chamber in a state where the treatment object X is placed thereon.

That is, the cylinder mechanism 6*a* is actuated to advance the pusher 5, and the tray T is pressed by the pair of the abutting members 7 provided at the tip part of the cylinder mechanism 6*a*. Then, the pair of abutting members 7 abut two locations, which are different from each other in the circumferential direction, on the peripheral surface of the tray T, and press the tray T. Therefore, even if the pressing position of the pusher with respect to the tray T deviates in some degree due to the positional deviation of the tray T or the center of gravity of the treatment object X that is placed on the tray T deviates from the center of the tray T, the tray T is accurately conveyed to the lifting chamber 1*b* for a heating chamber forward in the linear direction.

Thus, when the treatment object X has been conveyed to the lifting chamber 1*b* for a heating chamber together with the tray T, the treatment object X is lifted to the heating chamber 2*a* by the lifting mechanism 12 for a heating chamber, and is heat-treated by the heating device 2.

When the heat treatment of the treatment object X is completed, the treatment object X is lowered to the lifting chamber 1*b* for a heating chamber by the lifting mechanism 12 for a heating chamber. At this time, the upper lid 1*e* is lifted by the upper lid lifting mechanism, and the lift table 3*d* is lifted by the lifting mechanism for a cooling chamber and is arranged in the central chamber 1*a* of the intermediate conveyance chamber 1.

Next, the treatment object X, which has been lowered to the lifting chamber 1*b* for a heating chamber, is horizontally conveyed toward the lift table 3*d* in the central chamber 1*a* by the horizontal conveyance device 4. That is, the cylinder mechanism 6*b* is actuated to advance the pusher 5, and the tray T is pressed by the pair of abutting members 7 provided at the tip part of the cylinder mechanism 6*b*. Since the tray T is pressed by the pair of abutting members 7 in a state where the pair of abutting members 7 abut two locations, which are different from each other in the circumferential direction, on the peripheral surface of the tray T, the tray T is accurately conveyed onto the lift table 3*d* forward in the linear direction.

Next, the lift table 3*d* is lowered to the inside of the cooling chamber 3*a* by the lifting mechanism for a cooling chamber and the upper lid 1*e* is closed by the upper lid lifting mechanism, and then cooling treatment of the treatment object X is performed by the cooling device 3. Then, when the cooling treatment is completed, the upper lid 1*e* is lifted by the upper lid lifting mechanism, and the lift table 3*d* is lifted by the lifting mechanism for a cooling chamber.

In the horizontal conveyance device 4 in the heat treatment device S of the present embodiment, the abutting members 7 are disposed at the tip part of the pusher 5 which presses the tray T so that the abutting members 7 abut locations, which are different from each other in the circumferential direction, on the outer peripheral surface of the tray T. Therefore, since the abutting members 7 come in contact with the different locations in the outer peripheral surface of the disk-like tray T and press the tray T, even if the pressing position of the pusher with respect to the tray T deviates in some degree due to the positional deviation of the tray T or the center of gravity of the treatment object X that is placed on the tray T deviates from the center of the tray T, the tray T can be accurately conveyed forward in an intended linear direction. Therefore, a situation in which heat treatment or the like on the treatment object X is not appropriately performed because the tray T is not accurately conveyed or the like can be prevented.

Additionally, since the guide rail 8 that guides the pair of abutting members 7 is provided, and the traveling rollers 10 traveling on the guide rail 8 are provided on the pair of abutting members 7, the distal end side (the abutting member 7 side) of the pusher 5 held in a cantilevered fashion by the pusher cylinder can be prevented from hanging down due to the pusher's own weight. Hence, the abutting members 7 can be made to accurately abut and press the tray T.

Additionally, the tray T is disc-like, and the pair of abutting members 7 are disposed so that the abutting members 7 abut two locations, which are different from each other in the circumferential direction, on the outer peripheral surface of the tray T. Therefore, since the pair of abutting members 7 come in contact with the two locations in the outer peripheral surface of the disk-like tray T and simultaneously press the tray T, even if the pressing position of the pusher with respect to the tray T deviates in some degree due to the positional deviation of the tray T or the center of gravity of the treatment object X that is placed on the tray T deviates from the center of the tray T, the tray T can be accurately conveyed forward in an intended linear direction.

Additionally, the plurality of traveling rollers 10 are provided in the traveling direction thereof in each abutting member 7, and are arranged so that the distance between two traveling rollers 10 located at the outermost portions of the plurality of traveling rollers 10 becomes longer than the length of the gap 8*a* of the guide rail 8. Therefore, since at least one traveling roller 10 is located on the guide rail 8 even when the abutting member 7 passes above the gap 8*a* of the guide rail 8, not all the traveling rollers 10 fall and fit into the gap 8*a*. Accordingly, the abutting member 7 can be made to stably travel on the guide rail 8 by virtue of the traveling rollers 10.

Additionally, since the tip part of the abutting member 7 is provided with the adjusting mechanism 11 that adjusts the length of the abutting member 7, the positional deviation between the abutting surfaces of the abutment locations of the abutting members 7 can be eliminated. Therefore, the tray T can be more accurately conveyed forward in an intended linear direction.

Since the heat treatment device S of the present embodiment includes the horizontal conveyance device 4, the tray T on which the treatment object is placed can be accurately conveyed to the heating device 2 side forward in an intended linear direction. Therefore, heat treatment can be appropriately performed on the treatment object X.

Although the preferred embodiment of this disclosure has been described above referring to the drawings, the contents of disclosure are not limited to the above-described embodiment. Various shapes, combinations, and the like of the respective constituent members, which are shown in the above-described embodiment, are examples, and can be variously changed on the basis of design requirements or the like without departing from the spirit of this disclosure.

For example, although the device including the two types of cylinder mechanism 6*a* and cylinder mechanism 6*b* has been described as the horizontal conveyance device 4 of the above embodiment, only any one type of cylinder mechanism may be included. Additionally, a device having a configuration other than the cylinder mechanism 6*a* and the cylinder mechanism 6*b* may be used so long as the cylinder mechanism has a rod in which a pair of abutting members are disposed so that the pair of abutting members abut two locations, which are different from each other in a circumferential direction, on an outer peripheral surface of a conveyed body (a tray T).

Additionally, in the above embodiment, although an example in which this disclosure is applied to the heat treatment device S having the three heating devices has been described, this disclosure is not limited to the above embodiment, and it is also possible to apply this disclosure to heat treatment devices including one, two, four or more heating devices.

INDUSTRIAL APPLICABILITY

According to the conveyance device for a heat treatment device and the heat treatment device of this disclosure, the abutting member serving as a pressing end presses the conveyed body in a state where the abutting member comes in contact with locations, which are different from each other in the circumferential direction, in the outer peripheral surface of the conveyed body. Therefore, even if the pressing position of the pusher with respect to the conveyed body deviates in some degree due to the positional deviation of the conveyed body or the center of gravity of the treatment object that is placed on the conveyed body deviates from the center of the conveyed body, the conveyed body can be accurately conveyed forward in an intended linear direction.

What is claimed is:

1. A conveyance device for a heat treatment device that presses a conveyed body to convey the conveyed body in a linear direction, the conveyance device comprising:

a cylinder mechanism which includes a retractable rod that presses the conveyed body, wherein:

a pair of abutting members are disposed at a tip part of the rod of the cylinder mechanism so that the pair of abutting members abut two locations, which are separate from each other in a circumferential direction, on an outer peripheral surface of the conveyed body;

a guide rail configured to guide the pair of abutting members; and each abutting member includes a traveling roller that travels on the guide rail.

2. The conveyance device for a heat treatment device according to claim 1, wherein the conveyed body is disc-shaped such that the outer peripheral surface is circular, and the pair of abutting members are arranged to abut two different circumferential locations on the circular outer peripheral surface of the disc-shaped conveyed body.

3. The conveyance device for a heat treatment device according to claim 1, wherein:

the guide rail is intermittently arranged via a gap in a length direction of the guide rail;

each abutting member includes a plurality of the traveling rollers disposed in a traveling direction of the traveling roller; and the plurality of traveling rollers are arranged so that a distance between two traveling rollers located at outermost portions of the plurality of traveling rollers becomes longer than a length of the gap.

4. The conveyance device for a heat treatment device according to claim 2, wherein:

the guide rail is intermittently arranged via a gap in a length direction of the guide rail;

each abutting member includes a plurality of the traveling rollers disposed in a traveling direction of the traveling roller; and the plurality of traveling rollers are arranged so that a distance between two traveling rollers located at outermost portions of the plurality of traveling rollers becomes longer than a length of the gap.

5. The conveyance device for a heat treatment device according to claim 1, wherein an adjusting mechanism that adjusts a length of the abutting member is disposed at a tip part of each abutting member.

6. The conveyance device for a heat treatment device according to claim 2, wherein an adjusting mechanism that adjusts a length of the abutting member is disposed at a tip part of each abutting member.

7. The conveyance device for a heat treatment device according to claim 3, wherein an adjusting mechanism that adjusts a length of the abutting member is disposed at a tip part of each abutting member.

8. The conveyance device for a heat treatment device according to claim 4, wherein an adjusting mechanism that adjusts a length of the abutting member is disposed at a tip part of each abutting member.

9. A heat treatment device comprising:

a heating device that heats a treatment object;

a conveyed body on which the treatment object is placed;

a conveyance chamber configured to convey the conveyed body, on which the treatment object is placed, to the heating device; and the conveyance device for a heat treatment device according to claim 1.

* * * * *